US011644265B1

(12) United States Patent
Oglesby

(10) Patent No.: US 11,644,265 B1
(45) Date of Patent: May 9, 2023

(54) SUPPRESSOR SHIELDING SYSTEM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 284 days.

(21) Appl. No.: 17/099,099

(22) Filed: Nov. 16, 2020

Related U.S. Application Data

(60) Provisional application No. 62/935,553, filed on Nov. 14, 2019.

(51) Int. Cl.
*F41A 21/30* (2006.01)

(52) U.S. Cl.
CPC ..... *F41A 21/30* (2013.01)

(58) Field of Classification Search
CPC .... F41A 21/24; F41A 21/30–38; F41A 21/44; F41A 13/00; F41A 13/12
USPC ..... 89/14.1–14.4; 181/223; 165/177–184
See application file for complete search history.

(56) References Cited

U.S. PATENT DOCUMENTS 8,015,908 B2 * 9/2011 Kline ..... F41A 21/30 89/14.4
8,397,615 B2 * 3/2013 Poling ..... F41A 21/30 89/14.3
8,967,325 B1 * 3/2015 Cronhelm ..... F41A 21/30 89/14.4
9,140,511 B2 * 9/2015 Michal ..... F41A 21/44
9,568,010 B2 * 2/2017 Adhvaryu ..... F04D 29/441
10,001,340 B1 * 6/2018 Oglesby ..... F41C 23/18
10,126,084 B1 * 11/2018 Oglesby ..... F41A 21/30
10,371,476 B1 * 8/2019 Oglesby ..... F41A 21/30
10,386,146 B2 * 8/2019 Spector ..... F41G 11/003
10,466,003 B2 * 11/2019 Thompson ..... F41A 21/24
10,480,885 B2 * 11/2019 Mohler ..... F41A 21/30
10,712,114 B2 * 7/2020 Roberts ..... F41A 13/12
10,866,051 B2 * 12/2020 Thompson ..... F41A 21/24
11,047,640 B1 * 6/2021 Lee ..... F41A 21/44
11,150,045 B1 * 10/2021 Oglesby ..... F41A 21/30
2014/0082990 A1 * 3/2014 Lee ..... F41A 21/44 42/96

* cited by examiner

*Primary Examiner* — Joshua E Freeman
*Assistant Examiner* — Benjamin S Gomberg
(74) *Attorney, Agent, or Firm* — Shaddock Law Group, PC

(57) ABSTRACT

A suppressor shielding system suppressor shielding system having a heat shield element, a thermal barrier, a heat shield mount, and a mounting collar. In certain exemplary embodiments, the mounting collar is formed so as to be attached or coupled to a firearm handguard. Alternatively, the mounting collar is formed so as to be attached or coupled to a firearm barrel.

20 Claims, 10 Drawing Sheets

SUPPRESSOR SHIELDING SYSTEM

CROSS-REFERENCE TO RELATED APPLICATIONS

This patent application claims the benefit of U.S. Patent Application No. 62/935,553, filed Nov. 14, 2019, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a suppressor shielding system for a firearm.

2. Description of Related Art

A suppressor or silencer is a device that is typically attached to or an integral part of a barrel of a firearm or air gun. The suppressor acts to reduce the amount of noise and visible muzzle flash generated when a firearm is fired. Suppressors are typically constructed of a metal cylinder with internal baffles to reduce the sound of firing by slowing and cooling the rapidly expanding gases from the firing of a cartridge through a series of chambers. Because the propellant gases exits the suppressor over a longer period of time and at a greatly reduced velocity, a reduced noise signature is produced.

Typically, suppressors are integral to the firearm's barrel, directly threaded to the barrel of the firearm (via interaction of an internally threaded portion of the suppressor and an externally threaded portion of the exterior of the barrel), or are attached or coupled to a "quick-detach" flash hider or other muzzle device (which typically includes a locking mechanism that allows the suppressor to be quickly installed or removed from the firearm).

During normal operation of a suppressed firearm, as rounds are fired, the barrel, surrounding components, and suppressor typically heats up and can cause burns to a user, if touched. Additionally, the heat can create a distinct thermal signature. Ofttimes, a handguard surrounds the barrel so as to provide an air gap between the barrel and a surface that is typically contacted by the user.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, there is no current design that allows for each shielding of a suppressor, while providing a sufficient air gap to allow improved cooling of the suppressor.

These and other disadvantages and shortcomings of the prior art are overcome by the features and elements of the present disclosure, wherein the suppressor shielding system provides an improved heat shield element that can be easily attached or coupled to a firearm barrel or handguard. By providing improved heat shielding and cooling and by surrounding at least a portion of the suppressor and/or related components, there is a significant reduction to the thermal signature of the suppressor and/or the related components.

In order to overcome the shortcomings of the currently known attachment arrangements and/or to provide an improved attachment system, in various exemplary, non-limiting embodiments, the suppressor shielding system of the present disclosure provides at least some of a substantially tubular heat shield element, which extends from a heat shield element barrel end to a heat shield element muzzle end, wherein a heat shield element aperture is formed through the heat shield element and is defined by one or more interior heat shield element side walls; a thermal barrier formed or positioned within at least a portion of the heat shield element aperture of the heat shield element; a heat shield mount, which extends from a heat shield mount barrel end to a heat shield mount muzzle end, wherein a heat shield mount aperture is formed through the heat shield mount and is defined by one or more interior heat shield mount side walls, wherein an at least partially internally threaded mount engagement portion extends from the heat shield mount barrel end, toward the heat shield mount muzzle end, and wherein a heat shield engagement portion is formed in a portion of the heat shield mount, the heat shield engagement portion having an outer surface shaped so as to be at least partially received within a portion of the heat shield element, proximate the heat shield element barrel end; and a mounting collar, which extends from a mounting collar barrel end to a mounting collar muzzle end, wherein a mounting collar aperture is formed through the mounting collar, wherein one or more firearm handguard attachment extensions extend from the mounting collar barrel end, away from the mounting collar muzzle end, and wherein an at least partially externally threaded mounting collar engagement portion extends from the mounting collar muzzle end, toward the mounting collar barrel end, and wherein external threads of the mounting collar engagement portion matingly correspond to internal threads of the mount engagement portion; wherein the heat shield mount is capable of being threadedly attached or coupled to the mounting collar, via interaction of the internal threads of the mount engagement portion and the external threads of the mounting collar engagement portion, such that if the heat shield engagement portion is at least partially received within a portion of the heat shield element and if the mounting collar is attached or coupled to a firearm handguard, the heat shield element extends from the firearm handguard to surround at least a portion of a suppressor.

In various exemplary, nonlimiting embodiments, the heat shield element is formed of an alloy or carbon fiber.

In various exemplary, nonlimiting embodiments, the heat shield element comprises two or more layers, attached or coupled together, via one or more adhesive backed layers.

In various exemplary, nonlimiting embodiments, the thermal barrier is formed of a ceramic or partially ceramic material.

In various exemplary, nonlimiting embodiments, the thermal barrier is sprayed or spray bonded to at least a portion of the interior heat shield element side walls of the heat shield element.

In various exemplary, nonlimiting embodiments, the thermal barrier comprises one or more layers of a plasma bonded ceramic.

In various exemplary, nonlimiting embodiments, the thermal barrier comprises one or more layers of a partially ceramic material.

In various exemplary, nonlimiting embodiments, the thermal barrier comprises one or more layers of plasma bonded zirconium ceramic and one or more layers of Aerogel sheet.

In various exemplary, nonlimiting embodiments, the thermal barrier is spray bonded to at least a portion of the interior heat shield element side walls of the heat shield element.

In various exemplary, non-limiting embodiments, the suppressor shielding system of the present disclosure provides at least some of a substantially tubular heat shield element, which extends from a heat shield element barrel end to a heat shield element muzzle end, wherein a heat shield element aperture is formed through the heat shield element and is defined by one or more interior heat shield element side walls; a thermal barrier formed or positioned within at least a portion of the heat shield element aperture of the heat shield element; a heat shield mount, which extends from a heat shield mount barrel end to a heat shield mount muzzle end, wherein a heat shield mount aperture is formed through the heat shield mount and is defined by one or more interior heat shield mount side walls, wherein a mount engagement portion extends from the heat shield mount barrel end, toward the heat shield mount muzzle end and includes one or more heat shield mount capture extensions extending at least partially into the heat shield mount aperture, and wherein a heat shield engagement portion is formed in a portion of the heat shield mount, the heat shield engagement portion having an outer surface shaped so as to be at least partially received within a portion of the heat shield element, proximate the heat shield element barrel end; and a mounting collar, which extends from a mounting collar barrel end to a mounting collar muzzle end, wherein a mounting collar aperture is formed through the mounting collar, wherein the mounting collar aperture includes a recessed portion, so as to allow a portion of a threaded portion of a barrel to extend through the mounting collar aperture, wherein a mounting collar engagement portion extends from the mounting collar muzzle end, toward the mounting collar barrel end, the mounting collar engagement portion having an outer surface shaped so as to be at least partially received within a portion of the heat shield mount aperture, wherein one or more mounting collar capture recesses are formed in the mounting collar engagement portion, each mounting collar capture recess formed so as to allow at least a portion of a corresponding heat shield engagement portion to be received at least partially therein; wherein the heat shield mount is capable of being attached or coupled to the mounting collar, via interaction of the mounting collar capture recesses and corresponding heat shield engagement portions, such that if the heat shield engagement portion is at least partially received within a portion of the heat shield element and if the mounting collar is attached or coupled to a firearm barrel, the heat shield element extends from the firearm barrel to surround at least a portion of a suppressor.

In various exemplary, nonlimiting embodiments, each heat shield mount capture extension extends from a terminal portion of a flexible finger formed within a portion of the mount engagement portion of the heat shield mount.

In various exemplary, nonlimiting embodiments, one or more air flow vents are formed through the mounting collar.

In various exemplary, nonlimiting embodiments, each mounting collar capture recess is formed such that rotational movement of the heat shield mount relative to the mounting collar allows at least a portion of the heat shield engagement portion to be received at least partially within the corresponding mounting collar capture recess.

In various exemplary, nonlimiting embodiments, the mounting collar aperture allows a shoulder between the threaded portion of the barrel and an exterior of the barrel to be fitted at least partially within the recessed portion of the mounting collar aperture.

In various exemplary, nonlimiting embodiments, the mounting collar is positioned relative to the barrel such that the externally threaded portion of the barrel extends through the mounting collar aperture and a muzzle device/suppressor mount is attached or coupled, via interaction of the external threads of the barrel and internal threads of the muzzle device/suppressor mount, so as to capture the mounting collar between the barrel and the muzzle device/suppressor mount.

In various exemplary, nonlimiting embodiments, a flat tension spring is positioned between the mounting collar and the heat shield mount, so as to provide tension between the mounting collar and the heat shield mount.

In various exemplary, nonlimiting embodiments, the heat shield element is formed of an alloy or carbon fiber.

In various exemplary, nonlimiting embodiments, the heat shield element comprises two or more layers, attached or coupled together, via one or more adhesive backed layers.

In various exemplary, nonlimiting embodiments, the thermal barrier is formed of a ceramic or partially ceramic material.

In various exemplary, non-limiting embodiments, the suppressor shielding system of the present disclosure provides at least some of a heat shield element extending from a heat shield element barrel end, wherein a heat shield element aperture is formed through the heat shield element and is defined by one or more interior heat shield element side walls; a thermal barrier formed or positioned within at least a portion of the heat shield element aperture of the heat shield element; a heat shield mount extending from a heat shield mount barrel end to a heat shield mount muzzle end, wherein a heat shield mount aperture is formed through the heat shield mount and is defined by one or more interior heat shield mount side walls, wherein an at least partially internally threaded mount engagement portion extends from the heat shield mount barrel end, toward the heat shield mount muzzle end, and wherein a heat shield engagement portion is formed in a portion of the heat shield mount, the heat shield engagement portion having an outer surface shaped so as to be at least partially received within a portion of the heat shield element, proximate the heat shield element barrel end; and a mounting collar extending from a mounting collar barrel end to a mounting collar muzzle end, wherein a mounting collar aperture is formed through the mounting collar, wherein at least one firearm handguard attachment extension extend from the mounting collar barrel end, away from the mounting collar muzzle end, and wherein an at least partially externally threaded mounting collar engagement portion extends from the mounting collar muzzle end, toward the mounting collar barrel end, and wherein external threads of the mounting collar engagement portion matingly correspond to internal threads of the mount engagement portion; wherein the heat shield mount is capable of being threadedly attached or coupled to the mounting collar, via interaction of the internal threads of the mount engagement portion and the external threads of the mounting collar engagement portion, such that if the heat shield engagement portion is at least partially received within a portion of the heat shield element and if the mounting collar is attached or coupled to a firearm handguard, the heat shield element extends from the firearm handguard to surround at least a portion of a suppressor.

Accordingly, the present disclosure separately and optionally provides an improved suppressor shielding system.

The presently disclosed systems, methods, and/or apparatuses separately and optionally provide a suppressor shielding system that allows for the removable attachment or coupling the suppressor shielding system.

The presently disclosed systems, methods, and/or apparatuses separately and optionally provide a suppressor shielding system that allows for the fast and repeatable attachment of a heat shielding element to a firearm in a manner that ensures correct and repeatable timing of the device relative to the barrel.

The presently disclosed systems, methods, and/or apparatuses separately provide a suppressor shielding system that significantly reduces the thermal signature of a firearm suppressor and/or the related components.

The presently disclosed systems, methods, and/or apparatuses separately provide a suppressor shielding system that at least partially obscures a hot suppressor from thermal cameras and the like.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
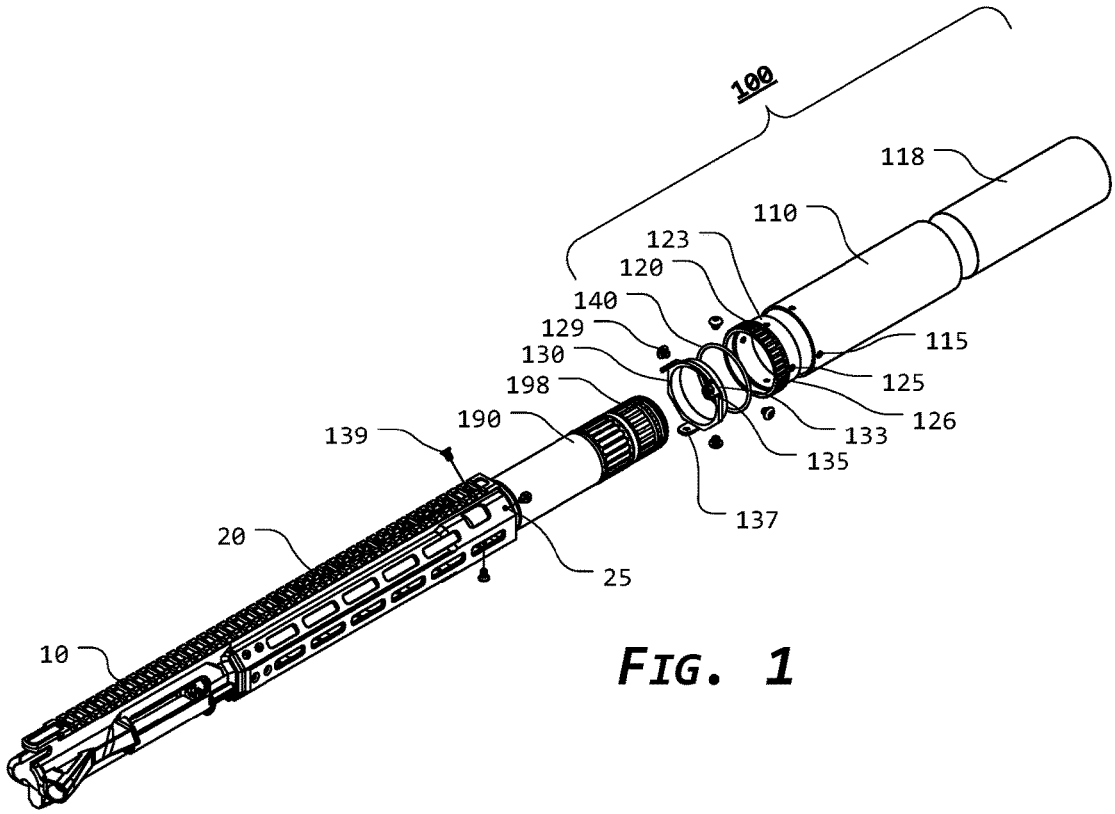
FIG. 1 illustrates a partially exploded rear perspective view of certain components of an exemplary embodiment of a suppressor shielding system, according to the presently disclosed systems, methods, and/or apparatuses.

The foregoing and other objectives, features, and advantages of the invention will be more readily understood upon consideration of the following description of the invention taken in conjunction with the accompanying drawings.

For simplicity and clarification, the design factors and operating principles of the suppressor shielding system according to the presently disclosed systems, methods, and/or apparatuses are explained with reference to various exemplary embodiments of a suppressor shielding system according to the presently disclosed systems, methods, and/or apparatuses. The basic explanation of the design factors and operating principles of the suppressor shielding system is applicable for the understanding, design, and operation of the suppressor shielding system of the presently disclosed systems, methods, and/or apparatuses. It should be appreciated that the suppressor shielding system can be adapted to many applications where a suppressor shielding system can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "suppressor shielding system", "suppressor", "heat shield", "thermal barrier", and "firearm" are used for basic explanation and understanding of the operation of the presently disclosed systems, methods, and/or apparatuses. Therefore, the terms "suppressor shielding system", "suppressor", "heat shield", "thermal barrier", and "firearm" are not to be construed as limiting the systems, methods, and/or apparatuses of the present disclosure. Thus, for example, the term "heat shield" is to be understood to broadly include any element that is able to at least partially shield radiating/transmitted heat or thermal energy.

For simplicity and clarification, the suppressor shielding system of the present disclosure will be described as being used in conjunction with an exemplary barrel and/or handguard. However, it should be appreciated that these are merely exemplary embodiments of the suppressor shielding system and are not to be construed as limiting the presently disclosed systems, methods, and/or apparatuses. Thus, the suppressor shielding system of the present disclosure may be utilized in conjunction with any barrel, handguard, or device.

Figure 2:
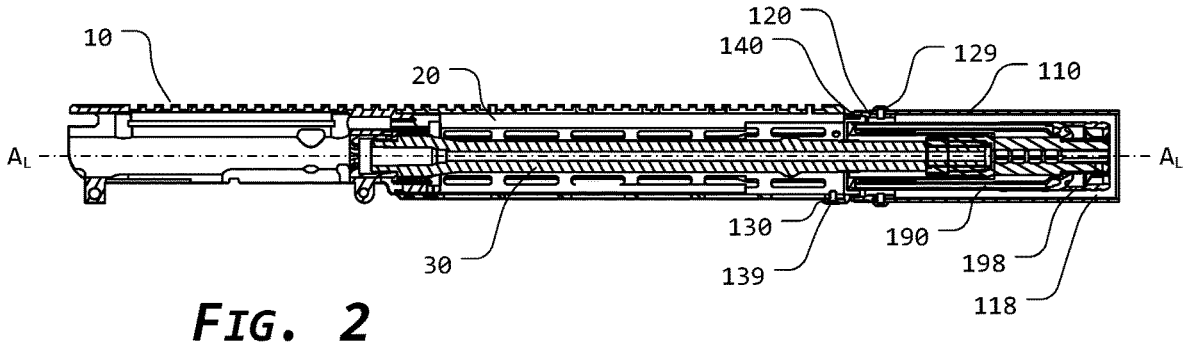
FIG. 2 illustrates a side, cross-sectional view of certain components of an exemplary embodiment of a suppressor shielding system, according to the presently disclosed systems, methods, and/or apparatuses.
Figure 3:
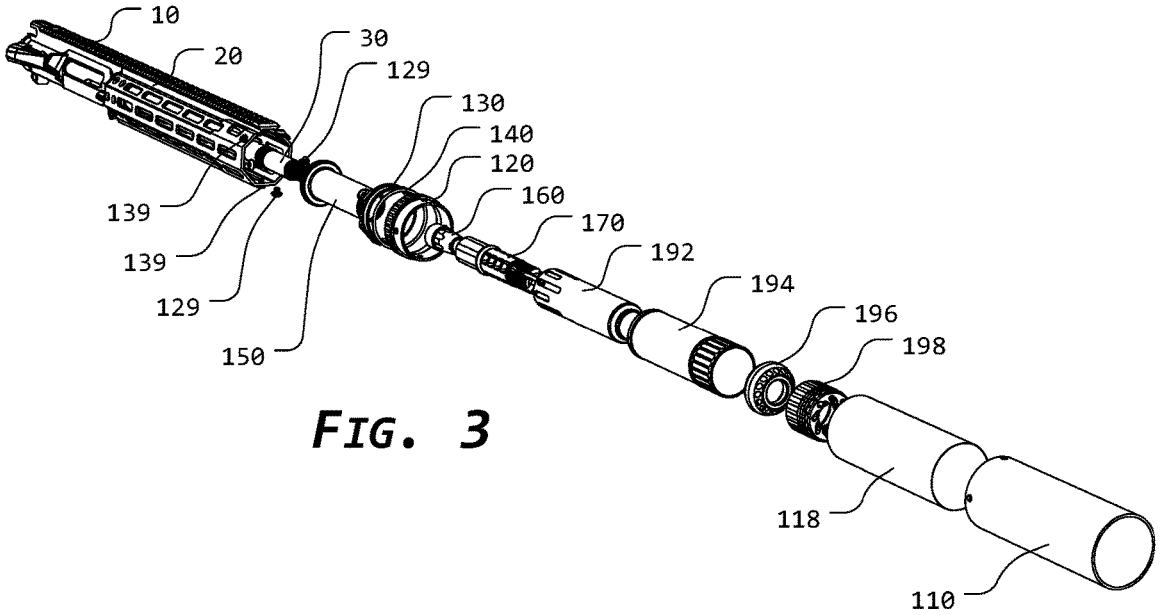
FIG. 3 illustrates an exploded front perspective view of certain components of an exemplary embodiment of a suppressor shielding system, according to the presently disclosed systems, methods, and/or apparatuses.
Figure 4:
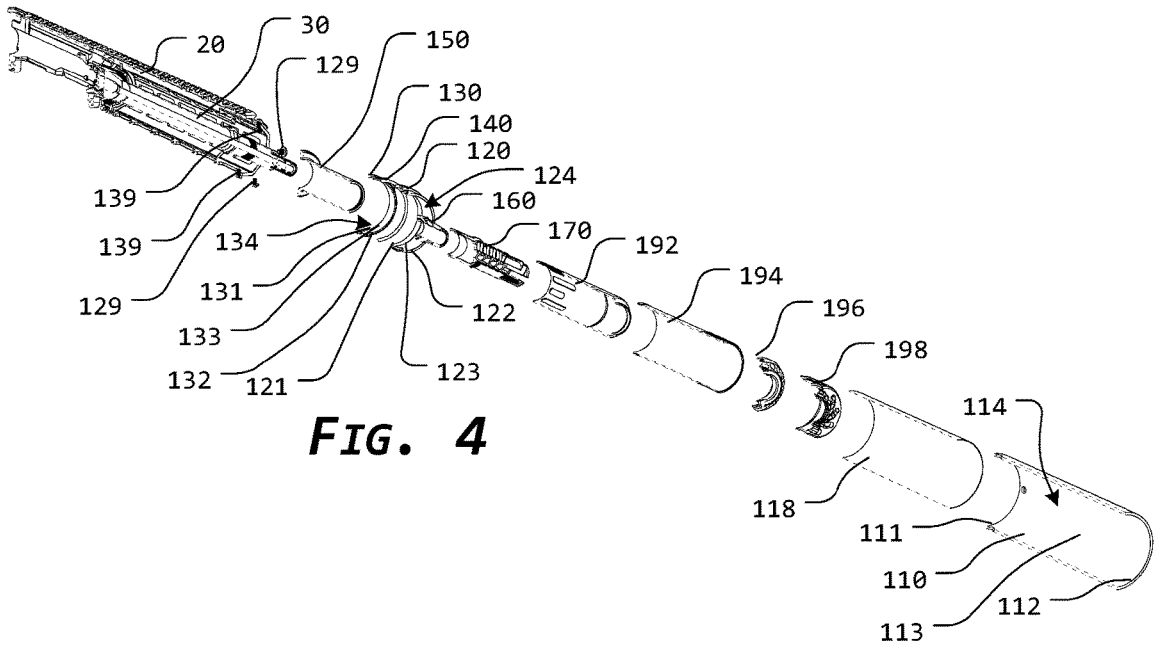
FIG. 4 illustrates an exploded, front perspective, cross-sectional, view of certain components of an exemplary embodiment of a suppressor shielding system, according to the presently disclosed systems, methods, and/or apparatuses.
Figure 5:
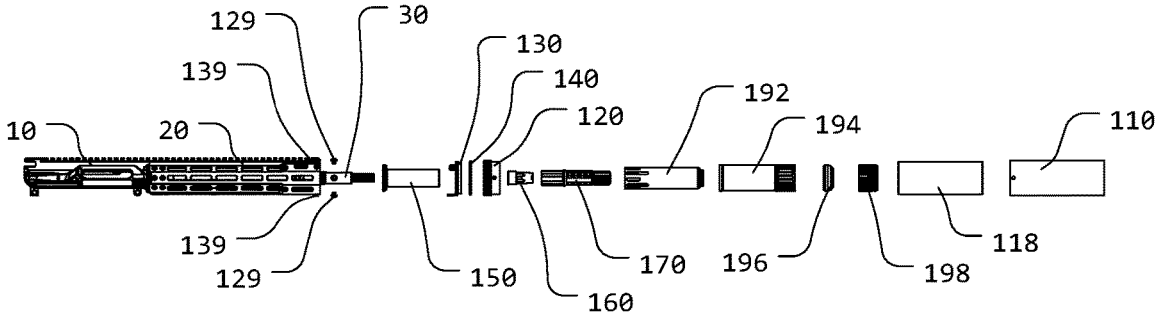
FIG. 5 illustrates an exploded, side view of certain components of an exemplary embodiment of a suppressor shielding system, according to the presently disclosed systems, methods, and/or apparatuses.
Figure 6:
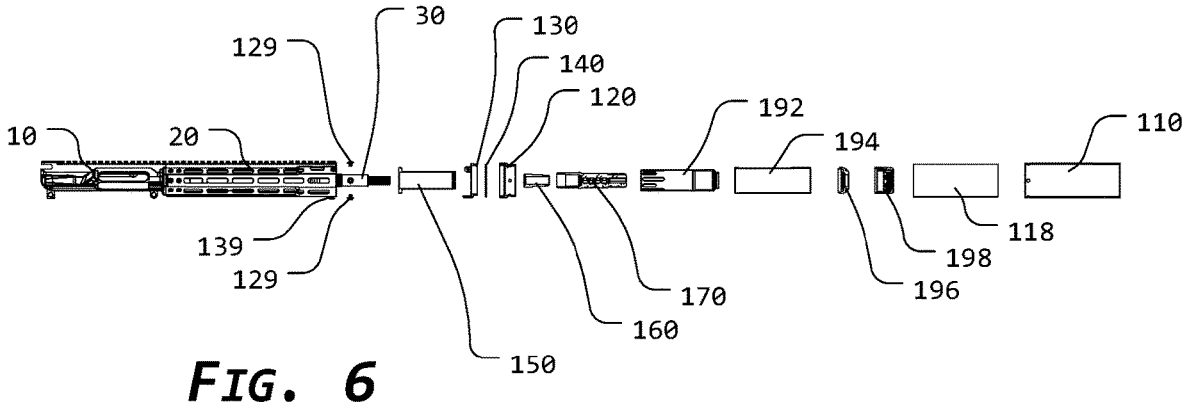
FIG. 6 illustrates an exploded, side, cross-sectional view of certain components of an exemplary embodiment of a suppressor shielding system, according to the presently disclosed systems, methods, and/or apparatuses.
Figure 7:
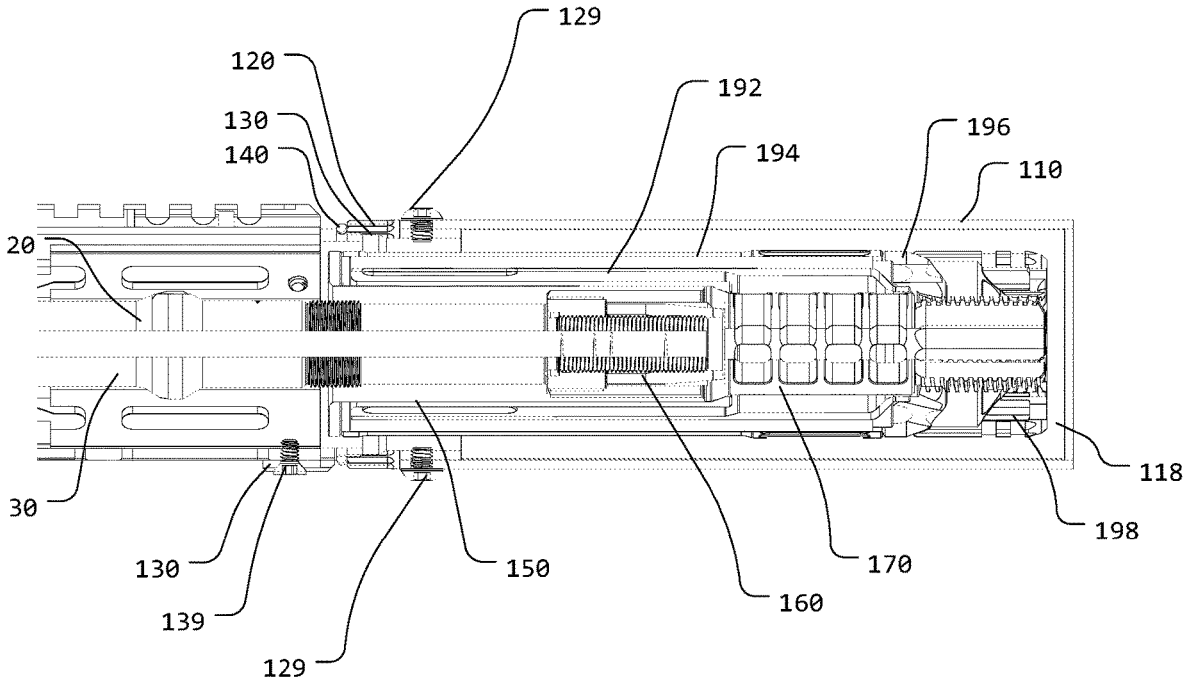
FIG. 7 illustrates a side, cross-sectional view of certain components of an exemplary embodiment of a suppressor shielding system, according to the presently disclosed systems, methods, and/or apparatuses.
Figure 8:
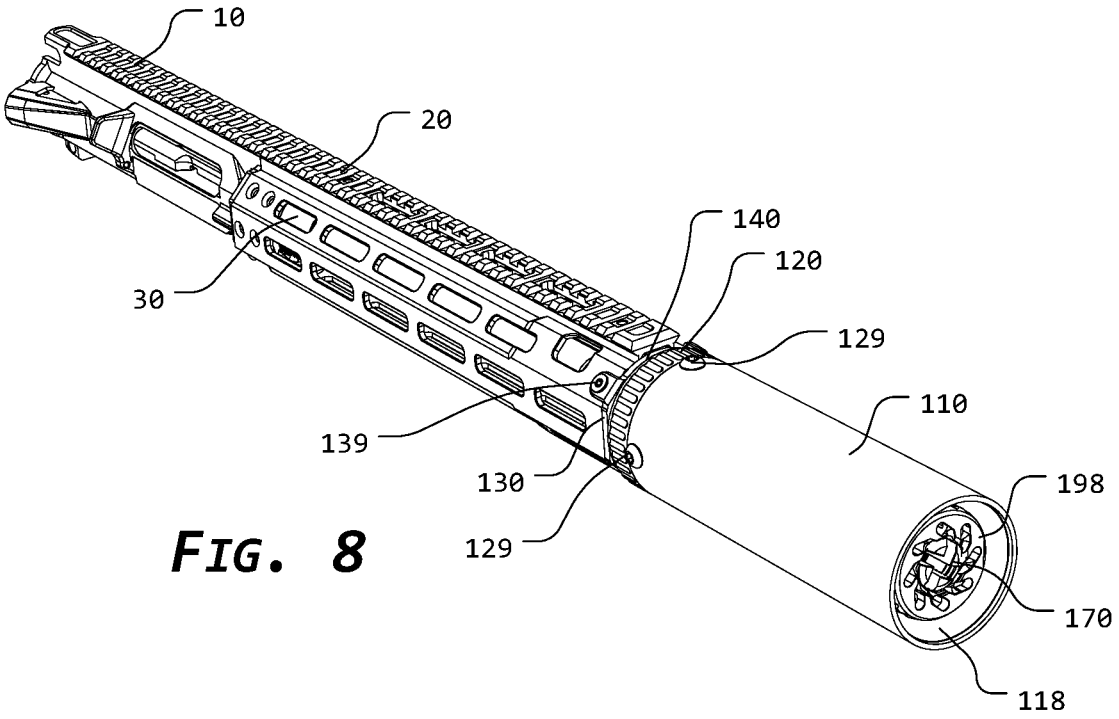
FIG. 8 illustrates a front, perspective view of certain components of an exemplary embodiment of a suppressor shielding system, according to the presently disclosed systems, methods, and/or apparatuses.
Figure 9:
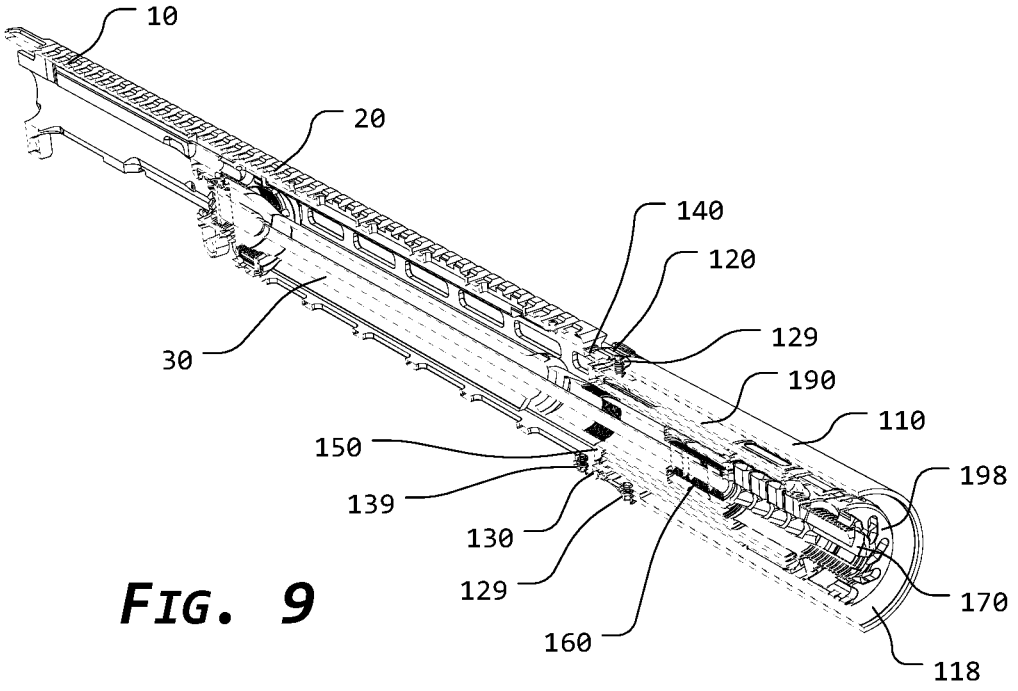
FIG. 9 illustrates a front, perspective, cross-sectional view of certain components of an exemplary embodiment of a suppressor shielding system, according to the presently disclosed systems, methods, and/or apparatuses.
Figure 10:
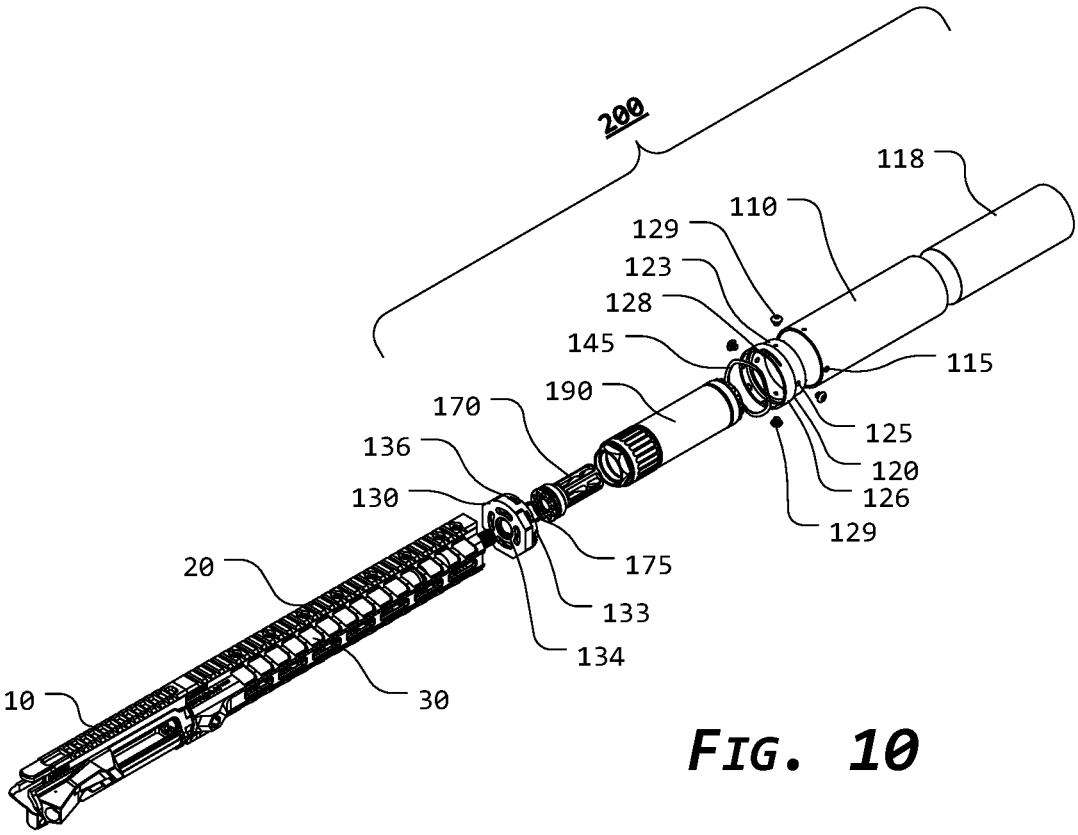
FIG. 10 illustrates an exploded rear perspective view of certain components of an exemplary embodiment of a suppressor shielding system, according to the presently disclosed systems, methods, and/or apparatuses.
Figure 11:
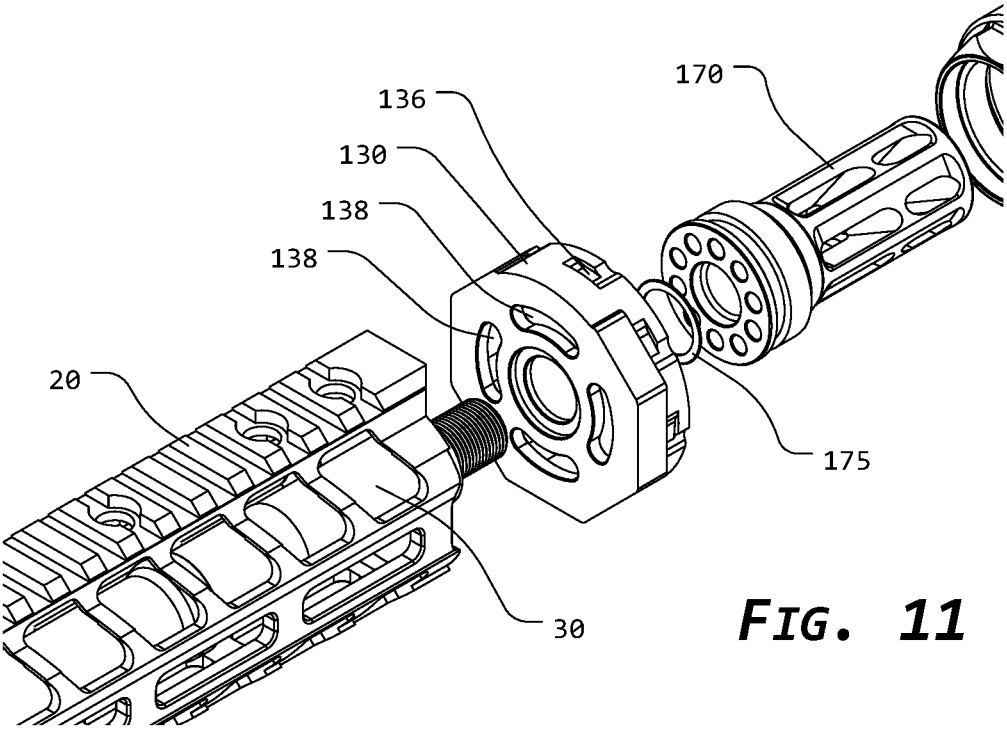
FIG. 11 illustrates a more detailed exploded rear perspective view of certain components of an exemplary embodiment of a suppressor shielding system, according to the presently disclosed systems, methods, and/or apparatuses.
Figure 12:
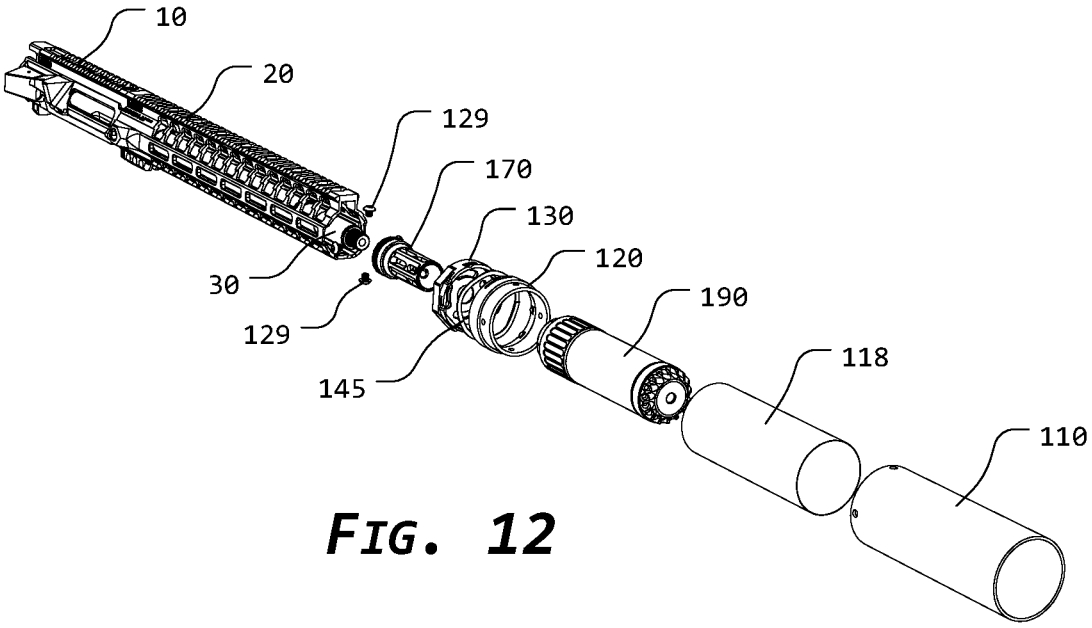
FIG. 12 illustrates an exploded front perspective view of certain components of an exemplary embodiment of a suppressor shielding system, according to the presently disclosed systems, methods, and/or apparatuses.
Figure 13:
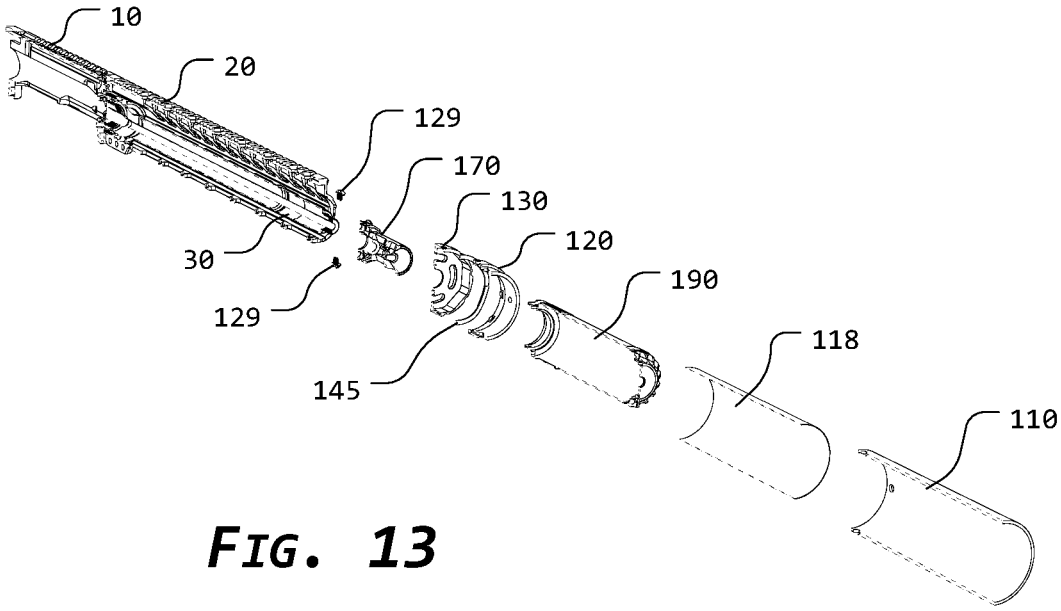
FIG. 13 illustrates an exploded, front perspective, cross-sectional, view of certain components of an exemplary embodiment of a suppressor shielding system, according to the presently disclosed systems, methods, and/or apparatuses.
Figure 14:
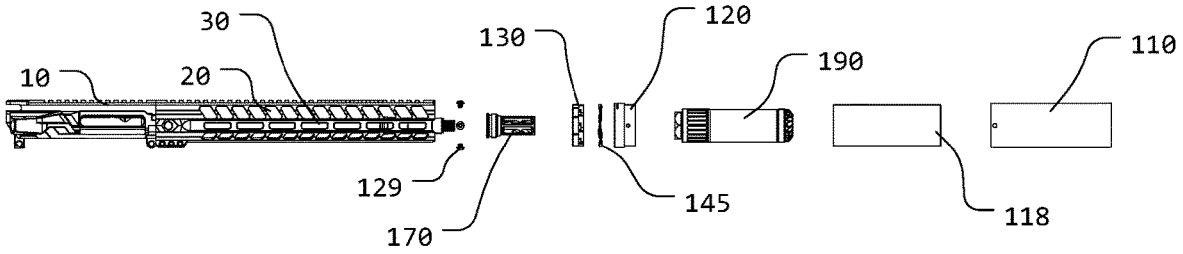
FIG. 14 illustrates an exploded, side view of certain components of an exemplary embodiment of a suppressor shielding system, according to the presently disclosed systems, methods, and/or apparatuses.
Figure 15:
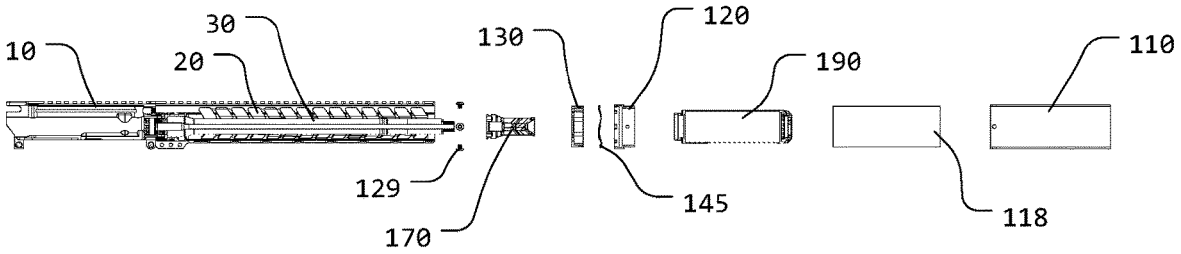
FIG. 15 illustrates an exploded, side, cross-sectional view of certain components of an exemplary embodiment of a suppressor shielding system, according to the presently disclosed systems, methods, and/or apparatuses.
Figure 16:
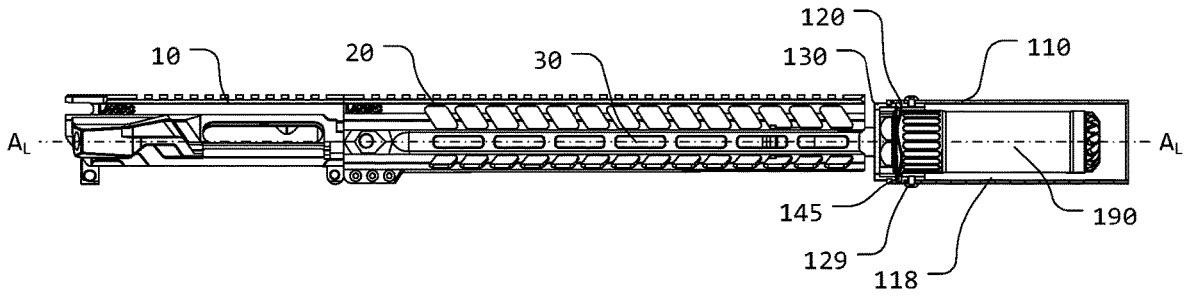
FIG. 16 illustrates a side, partial cross-sectional view of certain components of an exemplary embodiment of a suppressor shielding system, according to the presently disclosed systems, methods, and/or apparatuses.
Figure 17:
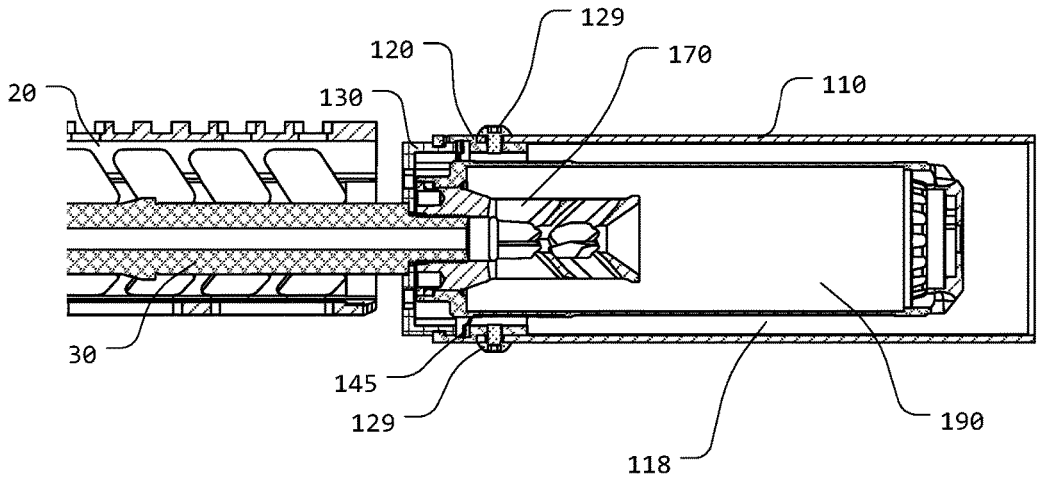
FIG. 17 illustrates a side, cross-sectional view of certain components of an exemplary embodiment of a suppressor shielding system, according to the presently disclosed systems, methods, and/or apparatuses.
Figure 18:
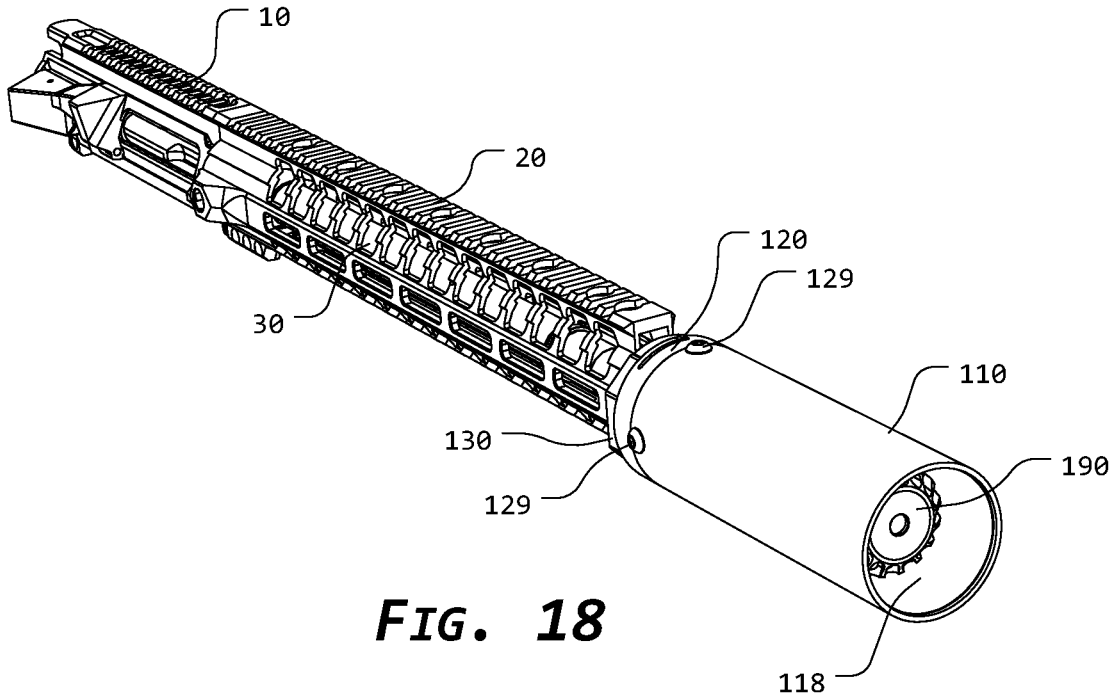
FIG. 18 illustrates a front, perspective view of certain components of an exemplary embodiment of a suppressor shielding system, according to the presently disclosed systems, methods, and/or apparatuses.
Figure 19:
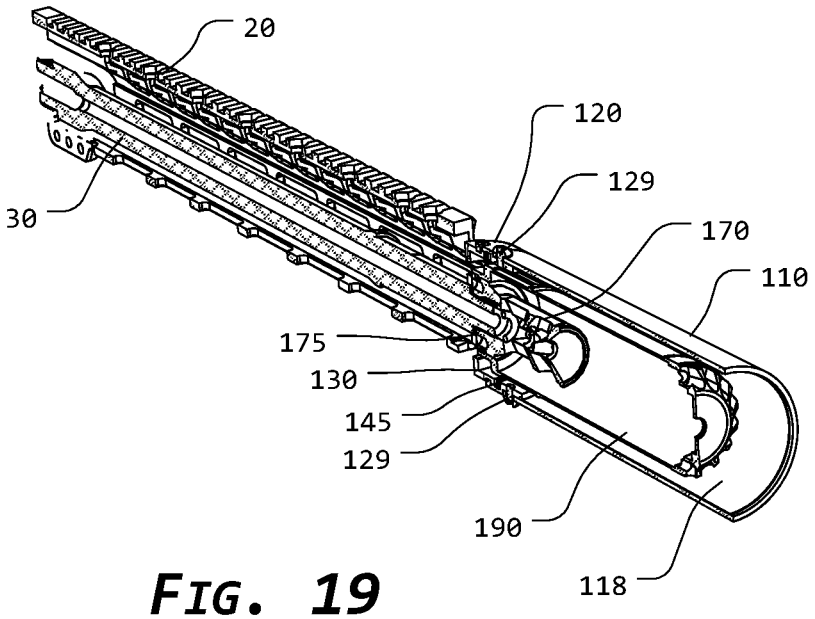
FIG. 19 illustrates a front, perspective, cross-sectional view of certain components of an exemplary embodiment of a suppressor shielding system, according to the presently disclosed systems, methods, and/or apparatuses.

In the form of the present disclosure chosen for purposes of illustration, FIGS. 1-9 illustrate various exploded, partially exploded, and/or assembled views of certain exemplary elements, components, and/or aspects of an exemplary embodiment of a suppressor shielding system 100. FIGS. 10-19 illustrate various exploded, partially exploded, and/or assembled views of certain exemplary elements, components, and/or aspects of an exemplary embodiment of a suppressor shielding system 200.

In illustrative, non-limiting embodiment(s) of the present disclosure, as illustrated in FIGS. 1-9, the suppressor shielding system 100 comprises at least some of a heat shield element 110, a thermal barrier 118, a heat shield mount 120, and a mounting collar 130. These elements interact with portions of an exemplary firearm, typically comprising a barrel 30 extending from an upper receiver 10 and a handguard 20 extending from the upper receiver 10 and surrounding at least a portion of the barrel 30.

As illustrated, the heat shield element 110 comprises a substantially tubular portion of material, which extends, along a longitudinal axis, $A_L$, from a heat shield element barrel end 111 to a heat shield element muzzle end 112. A heat shield element aperture 114 is formed through the heat shield element 110 and is defined by one or more interior heat shield element side walls 113 forming an interior surface of the heat shield element 110.

One or more heat shield fastener apertures 115 are formed through the heat shield element 110, proximate the heat shield element muzzle end 112. In various exemplary embodiments, a plurality of heat shield fastener apertures 115 are formed through the heat shield element 110, at substantially equally spaced locations.

In certain exemplary embodiments, the heat shield element 110 is formed of an alloy or carbon fiber. However, the heat shield element 110 may be formed of various desired materials and is not limited to being formed of carbon fiber.

In certain exemplary embodiments, the heat shield element 110 also comprises two or more layers, attached or coupled together. The two or more layers may optionally be attached or coupled together, via one or more adhesive backed layers. One or more of the adhesive backed layers may optionally comprise a 3M™ Ultra High Temperature Adhesive Transfer Tape, such as, for example, 9082 & 9085 UHT tape to hold the two or more layers in place.

A thermal barrier 118 is positioned or formed within at least a portion of a heat shield element aperture 114 of the heat shield element 110. The thermal barrier 118 is included to slow down heat soaking of the parts or components. In certain exemplary embodiments, the thermal barrier 118 is formed of a ceramic or partially ceramic material. The thermal barrier 118 may comprise a portion of material attached or coupled, using mechanical fasteners and/or high temperature adhesives, to at least a portion of an interior heat shield element side walls 113 of the heat shield element 110. Alternatively, the thermal barrier 118 may be sprayed or spray bonded to at least a portion of the interior heat shield element side walls 113 of the heat shield element 110.

In certain exemplary, nonlimiting embodiments, the thermal barrier 118 may comprise one or more layers of a flexible plasma bonded ceramic or partially ceramic material. For example, the thermal barrier 118 may comprise one or more layers of Zircoflex, in the form of a thin alloy sheet of flexible plasma bonded zirconium ceramic and one or more layers formed of a flexible Aerogel sheet. The sheets of Zircoflex and/or Aerogel may be used individually or sandwiched together to at least a portion of an interior heat shield element side walls 113 of the heat shield element 110. Currently, Zircoflex is available in three thicknesses, with better thermal protection in the thicker form. While any thickness of material can be utilized, a thicker form of the material is typically utilized in areas of higher heat.

It should also be appreciated that Zircoflex and/or Aerogel may optionally be utilized within the heat shield element 110, as a thermal barrier 118, and may also optionally be utilized within portions of the handguard 20.

In exemplary embodiments in which the thermal barrier 118 is sprayed or spray bonded to at least a portion of the interior heat shield element side walls 113 of the heat shield element 110, a zirconium ceramic or other materials may be plasma spray bonded or otherwise applied directly to a portion of the interior heat shield element side walls 113 of the heat shield element 110.

The heat shield mount 120 extends, along a longitudinal axis, $A_L$, from a heat shield mount barrel end 121 to a heat shield mount muzzle end 122. A heat shield mount aperture 124, defined by one or more interior heat shield mount side walls 123, extends through the heat shield mount 120. A mount engagement portion 126 extends from the heat shield mount barrel end 121, toward the heat shield mount muzzle end 122, and includes an internally threaded portion formed within a portion of the heat shield mount aperture 124. A heat shield engagement portion 123 is formed in a portion of the heat shield mount 120. The heat shield engagement portion 123 includes an outer surface shaped so as to be at least partially received within a portion of the heat shield element 110, proximate the heat shield element barrel end 111 of the heat shield element 110.

One or more corresponding heat shield mount fastener apertures 125 are formed in the heat shield engagement portion 123 of the heat shield mount 120. In various exemplary embodiments, at least one heat shield mount fastener aperture 125 corresponds to each heat shield fastener aperture 115, such that when the heat shield engagement portion 123 is appropriately positioned within the heat shield element 110, a heat shield mount fastener aperture 125 is appropriately aligned with a heat shield fastener aperture 115. In various exemplary embodiments, each heat shield mount fastener aperture 125 is internally threaded with internal threads that correspond to external threads of heat shield mount fasteners 129. Thus, once appropriately aligned, a heat shield mount fastener 129 is able to be positioned through each heat shield fastener aperture 115 and threadedly inserted within an aligned heat shield mount fastener aperture 125. In this manner, the heat shield element 110 can be appropriately aligned with and secured to the heat shield mount 120.

The mounting collar 130 extends, along a longitudinal axis, $A_L$, from a mounting collar barrel end 131 to a mounting collar muzzle end 132. A mounting collar aperture 134 extends through the mounting collar 130. One or more handguard attachment extensions 137 extend from the mounting collar barrel end 131 (away from the mounting collar muzzle end 132) and each handguard attachment extension 137 includes a mounting collar fastener aperture 135 formed therethrough. Each handguard attachment extension 137 and mounting collar fastener aperture 135 corresponds to a handguard fastener aperture 25 formed in the handguard 20.

A mounting collar engagement portion 133 extends from the mounting collar muzzle end 132, toward the mounting collar barrel end 131. At least a portion of the mounting collar engagement portion 133 is externally threaded. The external threads of the mounting collar engagement portion 133 matingly correspond to the internal threads of the mount engagement portion 126.

During attachment and/or use of certain exemplary embodiments of the suppressor shielding system 100, a suppressor 190 is attached or coupled to the barrel 30. In various exemplary embodiments, the suppressor 190 comprises a suppressor core 192, a suppressor body 194, and a suppressor end cap 196. The suppressor 190 is positioned through the mounting collar aperture 134 and the handguard attachment extensions 137 of the mounting collar 130 are aligned with the handguard fastener apertures 25, such that the mounting collar fastener apertures 135 are aligned with the handguard fastener apertures 25. A mounting collar fastener 139 is positioned through each mounting collar fastener aperture 135 and threadedly attached or coupled to internal threads of the handguard fastener aperture 25. In this manner, the mounting collar 130 is attached or coupled to the handguard 20.

Once the mounting collar 130 is appropriately attached or coupled to the handguard 20, the heat shield mount 120 is threadably attached or coupled to the mounting collar 130, via interaction of the internal threads of the mount engagement portion 126 and the external threads of the mounting collar engagement portion 133. Once appropriately threadedly attached, the heat shield element 110 and thermal barrier 118 surround at least a portion of the suppressor 190.

In various exemplary embodiments, the heat shield element 110 extends beyond a terminal end of the suppressor 190 (or suppressor flash cap 198).

In certain exemplary embodiments, a counter tension O-ring 140 may be positioned between the mounting collar 130 and the heat shield mount 120, so as to provide additional tension between the mounting collar 130 and the heat shield mount 120, to counteract unwanted or counter rotation of the heat shield mount 120 relative to the mounting collar 130.

In various exemplary embodiments, an internal heat shield 150 is also provided, that surround at least a portion of the barrel 30 and extends to cover certain additional elements, such as, for example, a muzzle device/suppressor mount adapter 160 and/or a portion of a muzzle device/suppressor mount 170.

In certain exemplary embodiments, the muzzle device/suppressor mount 170 includes external threads that interact with internal threads of a suppressor flash cap 198. If included, the suppressor 190 can be attached or coupled to the muzzle device/suppressor mount 170 via interaction of the external threads of the muzzle device/suppressor mount 170 and the internal threads of the suppressor flash cap 198.

In illustrative, non-limiting embodiment(s) of the present disclosure, as illustrated in FIGS. 10-19, the suppressor shielding system 200 comprises at least some of a heat shield element 210, a thermal barrier 218, a heat shield mount 220, and a mounting collar 230. These elements interact with an exemplary firearm, typically comprising a barrel 30 extending from an upper receiver 20 and a handguard 20 extending from the upper receiver 10 and surrounded at least a portion of the barrel 30.

As illustrated, the heat shield element 210 comprises a substantially tubular portion of material, which extends, along a longitudinal axis, $A_L$, from a heat shield element barrel end 211 to a heat shield element muzzle end 212. A heat shield element aperture 214 is formed through the heat shield element 210 and is defined by one or more interior heat shield element side walls 213 forming an interior heat shield element side walls 213 of the heat shield element 210.

One or more heat shield fastener apertures 215 are formed through the heat shield element 210, proximate the heat shield element muzzle end 212. In various exemplary embodiments, a plurality of heat shield fastener apertures 215 are formed through the heat shield element 210, at substantially equally spaced locations.

In certain exemplary embodiments, the heat shield element 210 is formed of an alloy or carbon fiber. However, the heat shield element 210 may be formed of various desired materials and is not limited to being formed of carbon fiber.

In certain exemplary embodiments, the heat shield element 210 also comprises two or more layers, attached or coupled together. The two or more layers may optionally be attached or coupled together, via one or more adhesive backed layers. One or more of the adhesive backed layers may optionally comprise a 3M™ Ultra High Temperature Adhesive Transfer Tape, such as, for example, 9082 & 9085 UHT tape to hold the two or more layers in place.

A thermal barrier 218 is positioned or formed within at least a portion of a heat shield element aperture 214 of the heat shield element 210. The thermal barrier 218 is included to slow down heat soaking of the parts or components. In certain exemplary embodiments, the thermal barrier 218 is formed of a ceramic or partially ceramic material. The thermal barrier 218 may comprise a portion of material attached or coupled, using mechanical fasteners and/or high temperature adhesives, to at least a portion of an interior heat shield element side walls 213 of the heat shield element 210. Alternatively, the thermal barrier 218 may be sprayed or spray bonded to at least a portion of an interior heat shield element side walls 213 of the heat shield element 210.

In certain exemplary, nonlimiting embodiments, the thermal barrier 218 may comprise one or more layers of a flexible plasma bonded ceramic or partially ceramic material. For example, the thermal barrier 218 may comprise one or more layers of Zircoflex, in the form of a thin alloy sheet of flexible plasma bonded zirconium ceramic and one or more layers formed of a flexible Aerogel sheet. The sheets of Zircoflex and/or Aerogel may be used individually or sandwiched together to at least a portion of an interior heat shield element side walls 213 of the heat shield element 210. Currently, Zircoflex is available in three thicknesses, with better thermal protection in the thicker form. While any thickness of material can be utilized, a thicker form of the material is typically utilized in areas of higher heat.

It should also be appreciated that Zircoflex and/or Aerogel may optionally be utilized within the heat shield element 210, as a thermal barrier 218, and may also optionally be utilized within portions of the handguard 20.

In exemplary embodiments in which the thermal barrier 218 is sprayed or spray bonded to at least a portion of the interior heat shield element side walls 213 of the heat shield element 210, a zirconium ceramic or other materials may be plasma spray bonded or otherwise applied directly to a portion of the interior heat shield element side walls 213 of the heat shield element 210.

The heat shield mount 220 extends, along a longitudinal axis, $A_L$, from a heat shield mount barrel end 221 to a heat shield mount muzzle end 222. A heat shield mount aperture 224 extends through the heat shield mount 220. A mount engagement portion 226 extends from the heat shield mount barrel end 221, toward the heat shield mount muzzle end 222, and includes one or more heat shield mount capture extensions 228, extending at least partially into the heat shield mount aperture 224. In various exemplary embodiments, each heat shield mount capture extension 228 extends from a terminal portion of a flexible finger formed within a portion of the mount engagement portion 226 of the heat shield mount 220. A heat shield engagement portion 223 is formed in a portion of the heat shield mount 220. The heat shield engagement portion 223 includes an outer surface shaped so as to be at least partially received within a portion of the heat shield element 210, proximate the heat shield element barrel end 211 of the heat shield element 210.

One or more corresponding heat shield mount fastener apertures 225 are formed in the heat shield engagement portion 223 of the heat shield mount 220. In various exemplary embodiments, at least one heat shield mount fastener aperture 225 corresponds to each heat shield fastener aperture 215, such that when the heat shield engagement portion 223 is appropriately positioned within the heat shield element 210, a heat shield mount fastener aperture 225 is appropriately aligned with a heat shield fastener aperture 215. In various exemplary embodiments, each heat shield mount fastener aperture 225 is internally threaded with internal threads that correspond to external threads of heat shield mount fasteners 229. Thus, once appropriately aligned, a heat shield mount fastener 229 is able to be positioned through each heat shield fastener aperture 215 and threadedly inserted within an aligned heat shield mount fastener aperture 225. In this manner, the heat shield element 210 can be appropriately aligned with and secured to the heat shield mount 220.

The mounting collar 230 extends, along a longitudinal axis, $A_L$, from a mounting collar barrel end 231 to a mounting collar muzzle end 232. A mounting collar aperture 234 extends through the mounting collar 230. The mounting collar aperture 234 is formed so as to allow at least a portion of the barrel 30 to pass therethrough. In various exemplary embodiments, the mounting collar aperture 234 includes a recessed portion, so as to allow a threaded portion of the barrel 30 to extend through the mounting collar aperture 234, and a shoulder between the threaded portion and an exterior of the barrel 30 can be fitted at least partially within the recessed portion of the mounting collar aperture 234.

In various exemplary, nonlimiting embodiments, one or more air flow vents 238 are formed through the mounting collar 230.

A mounting collar engagement portion 233 extends from the mounting collar muzzle end 232, toward the mounting collar barrel end 231. One or more mounting collar capture recesses 236 are formed in the mounting collar engagement portion 233. Each mounting collar capture recess 236 is formed so as to allow at least a portion of a corresponding heat shield engagement portion 223 to be received at least partially therein. In various exemplary embodiments, each mounting collar capture recess 236 is formed so as to allow a heat shield engagement portion 223 to be urged within a portion of the mounting collar capture recess 236. Then, rotational movement of the heat shield mount 220 relative to the mounting collar 230 allows the heat shield engagement portion 223 to be rotated within the mounting collar capture recess 236. Once appropriately rotated within the mounting collar capture recess 236, the heat shield engagement portion 223 engages a further recessed or detent to portion of the mounting collar capture recess 236 to further secure the heat shield mount 220 to the mounting collar 230.

During attachment and/or use of certain exemplary embodiments of the suppressor shielding system 200, the mounting collar 230 is positioned relative to the barrel 30 such that the externally threaded portion of the barrel 30 extends through the mounting collar aperture 234. A muzzle device/suppressor mount 270 is then attached or coupled, via interaction of the external threads of the barrel 30 and internal threads of the muzzle device/suppressor mount 270, so as to capture the mounting collar 230 between the barrel 30 and the muzzle device/suppressor mount 270. In various exemplary embodiments, a timing shim 275 may be provided between the mounting collar 230 and the muzzle device/suppressor mount 270 so as to allow the muzzle device/suppressor mount 270 to be rotationally timed relative to the barrel 30.

The suppressor 290 is then attached or coupled to the muzzle device/suppressor mount 270. In various exemplary embodiments, the suppressor 290 comprises a suppressor core 292, a suppressor body 294, and a suppressor end cap 296.

Once the suppressor 290 is appropriately attached or coupled to the muzzle device/suppressor mount 270, the heat shield mount 220 is partially rotatably attached or coupled to the mounting collar 230, via interaction of the heat shield engagement portion(s) 223 of the mount engagement portion 226 and the mounting collar capture recess(es) 236 of the mounting collar engagement portion 233. Once appropriately attached or coupled, the heat shield element 210 and thermal barrier 218 surround at least a portion of the suppressor 290.

In various exemplary embodiments, the heat shield element 210 extends beyond a terminal end of the suppressor 290.

In certain exemplary embodiments, a flat tension spring 245 may be positioned between the mounting collar 230 and the heat shield mount 220, so as to provide additional tension between the mounting collar 230 and the heat shield mount 220, to counteract unwanted or counter rotation of the heat shield mount 220 relative to the mounting collar 230.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A suppressor shielding system, comprising:

a substantially tubular heat shield element, which extends from a heat shield element barrel end to a heat shield element muzzle end, wherein a heat shield element aperture is formed through said heat shield element and is defined by one or more interior heat shield element side walls;

a thermal barrier formed or positioned within at least a portion of said heat shield element aperture of said heat shield element;

a heat shield mount, which extends from a heat shield mount barrel end to a heat shield mount muzzle end, wherein a heat shield mount aperture is formed through said heat shield mount and is defined by one or more interior heat shield mount side walls, wherein an at least partially internally threaded mount engagement portion extends from said heat shield mount barrel end, toward said heat shield mount muzzle end, and wherein a heat shield engagement portion is formed in a portion of said heat shield mount, said heat shield engagement portion having an outer surface shaped so as to be at least partially received within a portion of said heat shield element, proximate said heat shield element barrel end; and a mounting collar, which extends from a mounting collar barrel end to a mounting collar muzzle end, wherein a mounting collar aperture is formed through said mounting collar, wherein one or more firearm handguard attachment extensions extend from said mounting collar barrel end, away from said mounting collar muzzle end, and wherein an at least partially externally threaded mounting collar engagement portion extends from said mounting collar muzzle end, toward said mounting collar barrel end, and wherein external threads of said mounting collar engagement portion matingly correspond to internal threads of said mount engagement portion;

wherein said heat shield mount is capable of being threadedly attached or coupled to said mounting collar, via interaction of said internal threads of said mount engagement portion and said external threads of said mounting collar engagement portion, such that if said heat shield engagement portion is at least partially received within a portion of said heat shield element and if said mounting collar is attached or coupled to a firearm handguard, said heat shield element extends from said firearm handguard to surround at least a portion of a suppressor.

2. The suppressor shielding system of claim 1, wherein said heat shield element is formed of an alloy or carbon fiber.

3. The suppressor shielding system of claim 1, wherein said heat shield element comprises two or more layers, attached or coupled together, via one or more adhesive backed layers.

4. The suppressor shielding system of claim 1, wherein said thermal barrier is formed of a ceramic or partially ceramic material.

5. The suppressor shielding system of claim 1, wherein said thermal barrier is sprayed or spray bonded to at least a portion of said interior heat shield element side walls of said heat shield element.

6. The suppressor shielding system of claim 1, wherein said thermal barrier comprises one or more layers of a plasma bonded ceramic.

7. The suppressor shielding system of claim 1, wherein said thermal barrier comprises one or more layers of a partially ceramic material.

8. The suppressor shielding system of claim 1, wherein said thermal barrier comprises one or more layers of plasma bonded zirconium ceramic and one or more layers of Aerogel sheet.

9. The suppressor shielding system of claim 1, wherein said thermal barrier is spray bonded to at least a portion of said interior heat shield element side walls of said heat shield element.

10. A suppressor shielding system, comprising:

a substantially tubular heat shield element, which extends from a heat shield element barrel end to a heat shield element muzzle end, wherein a heat shield element aperture is formed through said heat shield element and is defined by one or more interior heat shield element side walls;

a thermal barrier formed or positioned within at least a portion of said heat shield element aperture of said heat shield element;

a heat shield mount, which extends from a heat shield mount barrel end to a heat shield mount muzzle end, wherein a heat shield mount aperture is formed through said heat shield mount and is defined by one or more interior heat shield mount side walls, wherein a mount engagement portion extends from said heat shield mount barrel end, toward said heat shield mount muzzle end and includes one or more heat shield mount capture extensions extending at least partially into said heat shield mount aperture, and wherein a heat shield engagement portion is formed in a portion of said heat shield mount, said heat shield engagement portion having an outer surface shaped so as to be at least partially received within a portion of said heat shield element, proximate said heat shield element barrel end; and a mounting collar, which extends from a mounting collar barrel end to a mounting collar muzzle end, wherein a mounting collar aperture is formed through said mounting collar, wherein said mounting collar aperture includes a recessed portion, so as to allow a portion of a threaded portion of a barrel to extend through said mounting collar aperture, wherein a mounting collar engagement portion extends from said mounting collar muzzle end, toward said mounting collar barrel end, said mounting collar engagement portion having an outer surface shaped so as to be at least partially received within a portion of said heat shield mount aperture, wherein one or more mounting collar capture recesses are formed in said mounting collar engagement portion, each said mounting collar capture recess formed so as to allow at least a portion of a corresponding one of said one or more heat shield mount capture extensions to be received at least partially therein;

wherein said heat shield mount is capable of being attached or coupled to said mounting collar, via interaction of said mounting collar capture recesses and said corresponding heat shield mount capture extensions, such that if said heat shield engagement portion is at least partially received within a portion of said heat shield element and if said mounting collar is attached or coupled to said barrel, said heat shield element extends from said barrel to surround at least a portion of a suppressor.

11. The suppressor shielding system of claim 10, wherein each said heat shield mount capture extension extends from a terminal portion of a flexible finger formed within a portion of said mount engagement portion of said heat shield mount.

12. The suppressor shielding system of claim 10, wherein one or more air flow vents are formed through said mounting collar.

13. The suppressor shielding system of claim 10, wherein each said mounting collar capture recess is formed such that rotational movement of said heat shield mount relative to said mounting collar allows at least a portion of each said heat shield mount capture extension to be received at least partially within a corresponding one of said one or more mounting collar capture recess.

14. The suppressor shielding system of claim 10, wherein said mounting collar aperture allows a shoulder between said threaded portion of said barrel and an exterior of said barrel to be fitted at least partially within said recessed portion of said mounting collar aperture.

15. The suppressor shielding system of claim 10, wherein said mounting collar is positioned relative to said barrel such that said threaded portion of said barrel extends through said mounting collar aperture and a muzzle device/suppressor mount is attached or coupled, via interaction of said threaded portion of said barrel and internal threads of said muzzle device/suppressor mount, so as to capture said mounting collar between said barrel and said muzzle device/suppressor mount.

16. The suppressor shielding system of claim 10, wherein a flat tension spring is positioned between said mounting collar and said heat shield mount, so as to provide tension between said mounting collar and said heat shield mount.

17. The suppressor shielding system of claim 10, wherein said heat shield element is formed of an alloy or carbon fiber.

18. The suppressor shielding system of claim 10, wherein said heat shield element comprises two or more layers, attached or coupled together, via one or more adhesive backed layers.

19. The suppressor shielding system of claim 10, wherein said thermal barrier is formed of a ceramic or partially ceramic material.

20. A suppressor shielding system, comprising:

a heat shield element extending from a heat shield element barrel end, wherein a heat shield element aperture is formed through said heat shield element and is defined by one or more interior heat shield element side walls;

a thermal barrier formed or positioned within at least a portion of said heat shield element aperture of said heat shield element;

a heat shield mount extending from a heat shield mount barrel end to a heat shield mount muzzle end, wherein a heat shield mount aperture is formed through said heat shield mount and is defined by one or more interior heat shield mount side walls, wherein an at least partially internally threaded mount engagement portion extends from said heat shield mount barrel end, toward said heat shield mount muzzle end, and wherein a heat shield engagement portion is formed in a portion of said heat shield mount, said heat shield engagement portion having an outer surface shaped so as to be at least partially received within a portion of said heat shield element, proximate said heat shield element barrel end; and a mounting collar extending from a mounting collar barrel end to a mounting collar muzzle end, wherein a mounting collar aperture is formed through said mounting collar, wherein at least one firearm handguard attachment extension extends from said mounting collar barrel end, away from said mounting collar muzzle end, and wherein an at least partially externally threaded mounting collar engagement portion extends from said mounting collar muzzle end, toward said mounting collar barrel end, and wherein external threads of said mounting collar engagement portion matingly correspond to internal threads of said mount engagement portion;

wherein said heat shield mount is capable of being threadedly attached or coupled to said mounting collar, via interaction of said internal threads of said mount engagement portion and said external threads of said mounting collar engagement portion, such that if said heat shield engagement portion is at least partially received within a portion of said heat shield element and if said mounting collar is attached or coupled to a firearm handguard, said heat shield element extends from said firearm handguard to surround at least a portion of a suppressor.

* * * * *